US010449649B2

(12) United States Patent
Kim et al.

(10) Patent No.: US 10,449,649 B2
(45) Date of Patent: Oct. 22, 2019

(54) RETAINER RING STRUCTURE FOR CHEMICAL-MECHANICAL POLISHING APPARATUS AND METHOD FOR MANUFACTURING THE SAME

(71) Applicant: CNUS CO., LTD., Siheung-si, Gyeonggi-do (KR)

(72) Inventors: Bu Soon Kim, Incheon (KR); Heung Sun Choi, Siheung-si (KR)

(73) Assignee: CNUS CO., LTD., Siheung-si, Gyeonggi-do (KR)

( * ) Notice: Subject to any disclaimer, the term of this patent is extended or adjusted under 35 U.S.C. 154(b) by 721 days.

(21) Appl. No.: 14/423,934

(22) PCT Filed: Jul. 10, 2013

(86) PCT No.: PCT/KR2013/006115
§ 371 (c)(1),
(2) Date: Feb. 25, 2015

(87) PCT Pub. No.: WO2014/035044
PCT Pub. Date: Mar. 6, 2014

(65) Prior Publication Data

US 2015/0183077 A1 Jul. 2, 2015

(30) Foreign Application Priority Data

Aug. 29, 2012 (KR) ..... 10-2012-0094838

(51) Int. Cl.
*B24B 7/07* (2006.01)
*B24B 37/32* (2012.01)

(52) U.S. Cl.
CPC ..... *B24B 7/07* (2013.01); *B24B 37/32* (2013.01); *Y10T 29/49826* (2015.01)

(58) Field of Classification Search
CPC ..... B24B 37/32; B24B 37/30
See application file for complete search history.

(56) References Cited

U.S. PATENT DOCUMENTS

2005/0113002 A1* 5/2005 Chen ..... B24B 37/32 451/42
2008/0076253 A1* 3/2008 Fukada ..... B24B 37/32 438/692
2008/0261497 A1* 10/2008 Ichinoshime ..... B24B 37/32 451/285

FOREIGN PATENT DOCUMENTS

JP 2011-224731 A 11/2011
KR 1020060131620 A 12/2006
(Continued)

OTHER PUBLICATIONS

Machine Translation—KR 20090123043 A, Choi Heung Sun, South Korea.*

(Continued)

*Primary Examiner* — Monica S Carter
*Assistant Examiner* — Lauren Beronja

(57) ABSTRACT

The present invention relates to a retainer ring structure for a CMP apparatus and a method for manufacturing the same. The retainer ring structure may include screws for fixing the retainer ring structure mounted on a polishing head during a CMP process, the screw being made of a high-strength metallic material, and the method for manufacturing the retainer ring structure may be simplified. Thus, a coupling force with the polishing head may be increased to reduce a defect rate, and the process may be simplified to reduce an operation time and a manufacturing cost, thereby increasing merchantability.

2 Claims, 3 Drawing Sheets

(56) References Cited

FOREIGN PATENT DOCUMENTS

| | | | | | |
|---|---|---|---|---|---|
| KR | 1020070027897 | A | | 3/2007 | |
| KR | 20090123043 | A | * | 12/2009 | |
| KR | 1020120095333 | A | | 8/2012 | |
| WO | WO 2011105730 | A2 | * | 9/2011 | ..... B24B 37/32 |

OTHER PUBLICATIONS

Machine Translation—WO 2011105730 A2, Lee Jae-Bok, South Korea.*

International Search Report dated Oct. 8, 2013; PCT/KR2013/006115.

* cited by examiner

【Fig. 1】
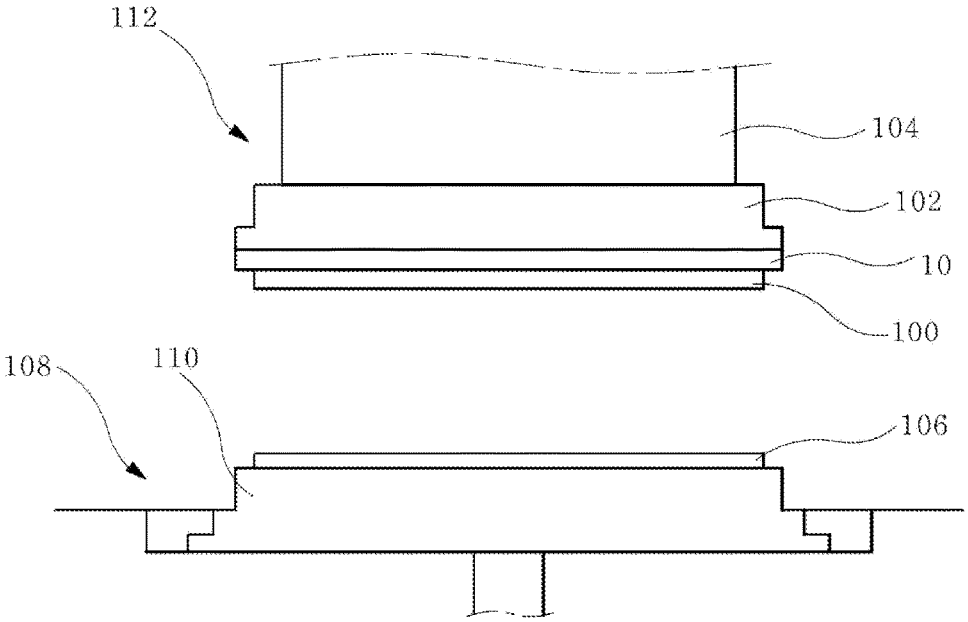
【Fig. 2】
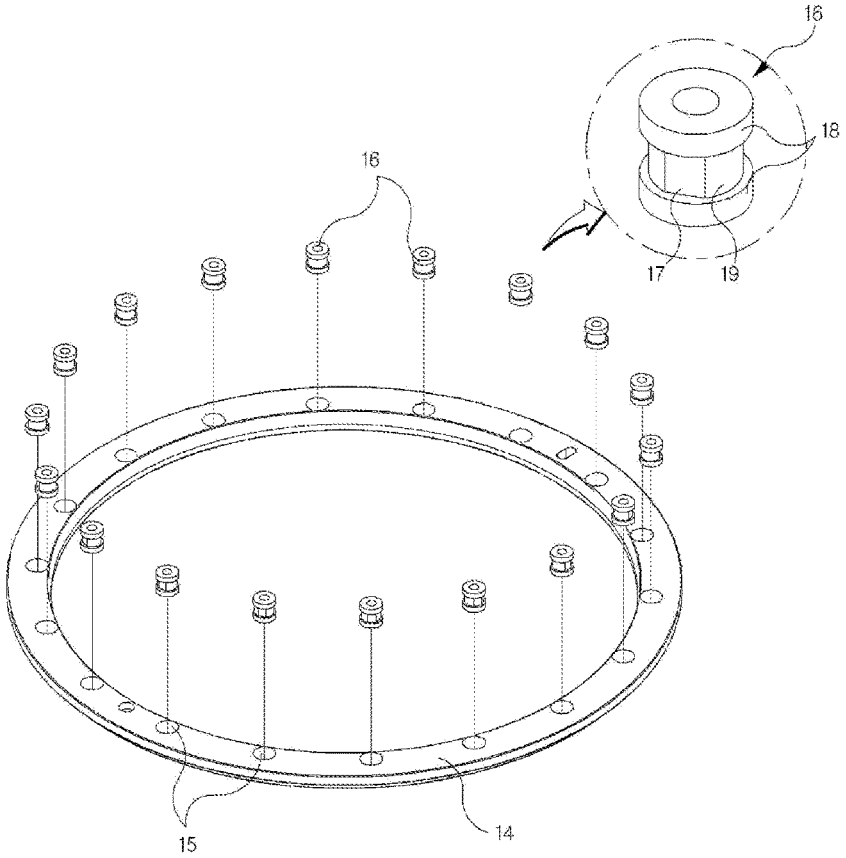

【Fig. 3】
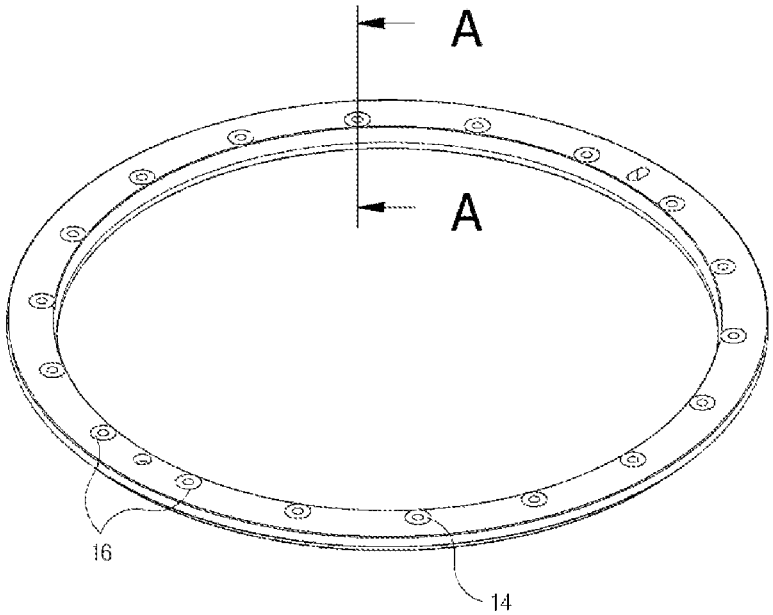
【Fig. 4】
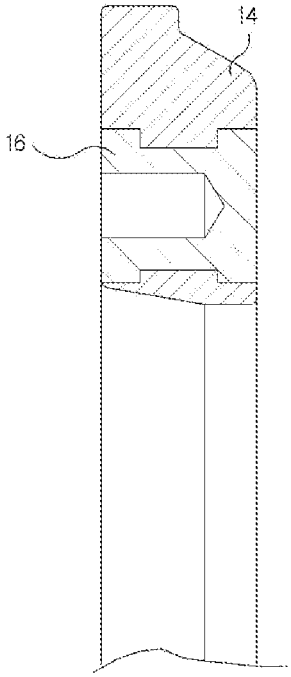

【Fig. 5】
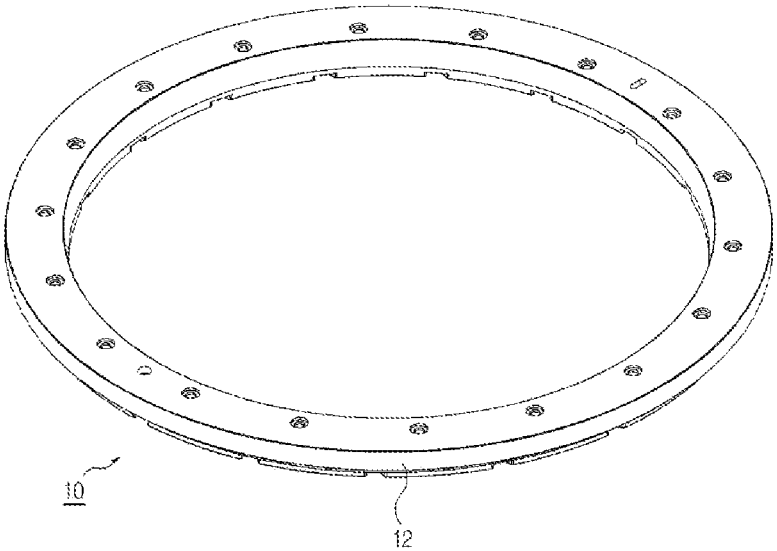
【Fig. 6】
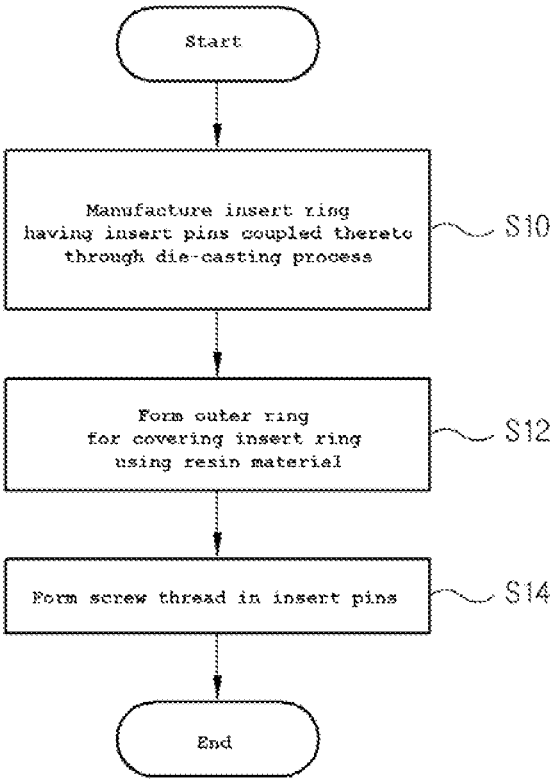

RETAINER RING STRUCTURE FOR CHEMICAL-MECHANICAL POLISHING APPARATUS AND METHOD FOR MANUFACTURING THE SAME

TECHNICAL FIELD

The present disclosure relates to a retainer ring structure for a chemical-mechanical polishing (CMP) apparatus and method for manufacturing the same, and more particularly, to a retainer ring structure for a CMP apparatus, in which a screw part for fixing the retainer ring structure to be mounted on a polishing head during a CMP process is formed of a high-strength metallic material and the other part is formed of a low-price metal alloy, and which is capable of reducing a manufacturing cost, lowering a defect rate by increasing a coupling force with a polishing head, and reducing an operation time by simplifying a process, thereby increasing merchantability, and a method for manufacturing the same.

BACKGROUND ART

According to the increase in speed and integration of semiconductor devices, there has been an increasing demand for a multilayer wiring structure which is capable of increasing the number of wiring layers and miniaturizing wiring patterns. Thus, the multilayer wiring technology is an important issue for a sub-micron process.

In particular, as a process margin for a depth of focus in an exposure device for forming a micro pattern shrinks with the age of sub-0.35 μm process, a global planarization technology for a chip area is required in order to secure a sufficient depth of focus.

Thus, in order to realize global planarization, a technology referred to as CMP is widely used. The CMP technology is necessarily applied to a method for fabricating a semiconductor device, and research is being actively conducted on next-generation elements. According to the recent trend, the CMP technology has been frequently applied to logic elements which require a multilayer wiring in order to increase the operation speed of the elements. Furthermore, the application of the CMP technology has gradually widened as more and more memory elements have a multilayer structure.

Furthermore, a CMP apparatus based on the CMP technology may include a retainer ring which is installed on a polishing head for fixing a wafer so as to perform a mechanical operation. The retainer ring is used to fix the regular position of a held wafer.

However, since the retainer ring is formed of a resin material such as plastic, the strength of the retainer ring is low. Furthermore, a planarization operation for the retainer ring, which is performed before a CMP process, requires a large amount of time, and uneven wear may occur due to an imbalance of force caused by cover bolt tightening.

Thus, a retainer ring structure including an inner ring and an outer ring is widely used. The inner ring serving as an insert ring is formed of a metallic material, and the outer ring covering the insert ring is formed of a resin material such as plastic.

The above-described retainer ring structure including an inner ring and an outer ring has been disclosed in a method for manufacturing a ring structure, which was applied and registered on Jun. 9, 2010 and titled "Method for manufacturing retainer ring of mechanical polishing apparatus", and a method for manufacturing a ring structure, which was applied and registered on Aug. 18, 2010 and titled "Retainer ring structure for CMP apparatus and method for manufacturing the same".

However, according to the method for manufacturing a retainer ring, a part to which a fastening screw mounted on a polishing head is fastened is formed of a resin material. Thus, the fastening screw inevitably has a small fastening force, and local deformation may occur when the fastening screw is coupled.

Furthermore, after the metallic inner ring is formed, an insert pin having a head formed thereon is coupled to a hole formed at the top surface of the inner ring. Then, a resin material is injected to mold a ring structure.

After the ring structure is cooled, the head of the insert pin is cut, and a hole or screw thread is formed in the body of the insert pin. Then, the retainer ring structure is completed. As described above, the method for manufacturing a retainer ring includes complex and many process steps. Thus, the manufacturing cost inevitably increases, and the manufacturing operation accompanies many difficulties.

DISCLOSURE

Technical Problem

Various embodiments are directed to a retainer ring structure for a CMP apparatus, in which a screw part for fixing the retainer ring structure to be mounted on a polishing head during a CMP process is formed of a high-strength metallic material, and which is capable of simplifying a manufacturing process, lowering a defect rate by increasing a coupling force with a polishing head, and reducing an operation time and manufacturing cost by simplifying a process, thereby increasing merchantability, and a method for manufacturing the same.

Technical Solution

In an embodiment, a retainer ring structure for a CMP apparatus may include: an insert ring having a plurality of holes formed at the top surface thereof so as to be coupled to a head of the CMP apparatus, and made of two or more kinds of metallic materials; a plurality of metallic insert pins coupled to the respective holes of the insert ring so as to be integrated with the insert ring, each having a body of which the top surface is opened and which has a screw thread formed therein, and made of a different material from the insert ring; and an outer ring formed to cover the insert ring except the top surfaces of the insert pins.

The insert pin may have higher strength than the insert ring. The insert pin may include a cylindrical body, a chamfered part formed by partially cutting the side surface of the body in the longitudinal direction, and a pair of disk-shaped heads formed at the top and bottom of the body and having a larger diameter than the size of the body.

In an embodiment, a method for manufacturing a retainer ring structure for a CMP apparatus may include: forming a plurality of holes at the top surface of an insert ring made of two or more kinds of metallic materials so as to be coupled a polishing head of the CMP apparatus, and coupling a plurality of cylindrical insert pins made of a different metallic material from the insert ring to the respective holes of the insert ring such that the insert ring and the insert pins are integrated with each other; mounting the insert ring having the insert pins coupled thereto in a mold, and injecting a resin material to cover the insert ring except the top surfaces of the insert pins, in order to form an outer ring formed of a resin material; and processing the insert pins such that the top surfaces of the insert pins are opened and the insert pins have a screw thread formed therein.

The insert pin may be made of stainless steel, and the insert ring may be made of a zing or aluminum alloy.

Advantageous Effects

According to the embodiments of the present invention, screws for fixing a retainer ring structure mounted on a polishing head during a CMP process may be made of a high-strength metallic material, and a method for manufacturing the retainer ring structure may be simplified. Thus, a coupling force with the polishing head may be increased to reduce a defect rate, and the manufacturing process may be simplified to reduce an operation time and a manufacturing cost, thereby increasing merchantability.

BRIEF DESCRIPTION OF DRAWINGS

FIG. 1 schematically illustrates that a retainer ring structure according to an embodiment of the present invention is mounted on a CMP apparatus.

FIG. 2 is a schematic perspective view of an insert ring and insert pins of the retainer ring structure according to the embodiment of the present invention.

FIG. 3 is a schematic perspective view of the inset ring of the retainer ring structure according to the embodiment of the present invention.

FIG. 4 is a cross-sectional view taken along line A-A of FIG. 3.

FIG. 5 is a schematic perspective view of the retainer ring structure according to the embodiment of the present invention.

FIG. 6 is a flowchart illustrating a method for manufacturing a retainer ring structure according to an embodiment of the present invention.

MODE FOR INVENTION

Hereafter, exemplary embodiments of the present invention will be described in detail with reference to the accompanying drawings.

As illustrated in FIG. 1, a retainer ring structure according to an embodiment of the present invention is represented by reference numeral 10. Referring to FIG. 1, the retainer ring structure 10 will be described as follows.

A CMP apparatus includes a main body 108 and a polishing head 112. The main body 108 include a polishing platen 110 mounted on the top surface thereof and a polishing pad 106 installed on the top surface of the polishing platen 110.

The polishing head 112 includes the retainer ring structure 10 for fixing a wafer 100, a polishing housing 102 having the retainer ring structure 10 mounted thereon, and a rotating arm 104. The polishing housing 102 is rotated by the rotating arm 104.

The polishing platen 110 has the polishing pad 106 installed on the top surface thereof and a rotating shaft 114 formed under the polishing pad 106 and connected to a driving unit. The surface of the wafer 100 is polished while coming in contact with the polishing pad 106. The polishing platen 110 is orbitally driven by the driving unit.

As illustrated in FIGS. 2 to 5, the retainer ring structure 10 includes an insert ring 14, a plurality of metallic insert pins 16, and an outer ring 12. The insert ring 14 has a plurality of holes 15 formed at the top surface thereof so as to be coupled to the polishing head 112 of the CMP apparatus, and is formed of two or more kinds of metals. The insert pins 16 are forced into the respective holes 15 of the insert ring 14 and processed to have a screw thread. The outer ring 12 is formed to cover the insert pins 16 and the insert ring 14.

As illustrated in FIG. 2, the insert pin 16 includes a cylindrical body 19, a chamfered part 17, and a pair of disk-shaped heads 18. The chamfered part 17 is formed by partially cutting the side surface of the body 19 in the longitudinal direction, and the pair of disk-shaped heads 18 have a larger diameter than the size of the body 19.

In particular, the reason that the chamfered part 17 is formed on the insert pin 16 is in order to more stably process the insert pin 16 during a post process of the insert pin 16, because the insert pin 16 is firmly coupled to the insert ring 14 formed of two kinds of metals.

A method for manufacturing the retainer ring structure according to the embodiment of the present invention will be described as follows.

First, a plurality of holes 15 to be coupled to the polishing head of the CMP apparatus are formed at the top surface of an insert ring 14 formed of two kinds of metals, and a plurality of insert pins 16 and the insert ring 14 are integrally formed through a die-cast process such that the insert pins 16 formed of a different metallic material from the material of the insert ring 14 are formed in the respective holes of the insert ring 14, at step S10.

At this time, the insert pin 16 has higher strength than the insert ring 14. The insert ring 14 may be formed of a zinc or aluminum alloy so as to only support the outer ring 12. However, since the insert pin 16 is post-processed and coupled to the polishing head of the CMP apparatus, the insert pin 16 may be formed of stainless steel, in order to maintain a more favorable fastening force.

Then, the insert ring 14 having the insert pins 16 coupled thereto is mounted on a mold, and a resin material is injected to form the outer ring 12 for covering the insert ring 14 using a resin material, at step S12. Then, the top surfaces of the insert pins 16 are opened and the insert pins 16 are processed to have screw threads therein, at step S14. Then, the retainer ring structure 10 is completed.

As described above, the insert pin 16 includes a cylindrical body 19, a chamfered part 17, and a pair of disk-shaped heads 18. The chamfered part 17 is formed by partially cutting the side surface of the body 19 in the longitudinal direction, and the pair of disk-shaped heads 18 have a larger diameter than the size of the body 19.

While various embodiments have been described above, it will be understood to those skilled in the art that the embodiments described are by way of example only. Accordingly, the disclosure described herein should not be limited based on the described embodiments.

INDUSTRIAL APPLICABILITY

According to the embodiments of the present invention, screws for fixing a retainer ring structure mounted on a polishing head during a CMP process may be formed of a high-strength metallic material, and a method for manufacturing the retainer ring structure may be simplified. Thus, a coupling force with the polishing head may be increased to reduce a defect rate, and the manufacturing process may be simplified to reduce an operation time and a manufacturing cost.

The invention claimed is:

1. A retainer ring structure for a chemical-mechanical polishing (CMP) apparatus, comprising:

an insert ring having a plurality of holes formed at a top surface thereof so as to be coupled to a head of the CMP apparatus, and made of two or more kinds of metallic materials;

a plurality of metallic insert pins coupled to the respective plurality of holes of the insert ring so as to be integrated with the insert ring, each having a cylindrical body of which a top surface is opened and which has a screw thread formed in the body, and made of a different material from the insert ring; and an outer ring formed to cover the insert ring except the top surfaces of the plurality of metallic insert pins, wherein each of the plurality of metallic insert pins comprises the cylindrical body, a chamfered part formed by partially cutting one side surface of the cylindrical body in the longitudinal direction such that the cut surface of the cylindrical body is flat, and a pair of disk-shaped heads formed at a top and bottom of the cylindrical body, wherein each of the disk-shaped heads has a larger diameter than a size of the cylindrical body.

2. A method for manufacturing a retainer ring structure for a CMP apparatus, comprising:

forming a plurality of holes at a top surface of an insert ring made of two or more kinds of metallic materials so as to be coupled a polishing head of the CMP apparatus, and coupling a plurality of cylindrical insert pins made of a different metallic material from the insert ring to the respective plurality of holes of the insert ring such that the insert ring and the plurality of cylindrical insert pins are integrated with each other;

mounting the insert ring having the plurality of cylindrical insert pins coupled thereto in a mold, and injecting a resin material to cover the insert ring except top surfaces of the plurality of cylindrical insert pins, in order to form an outer ring formed of a resin material; and processing the plurality of cylindrical insert pins such that the top surfaces of the plurality of cylindrical insert pins are opened and each of the plurality of cylindrical insert pins has a screw thread formed therein, wherein each of the plurality of cylindrical insert pins comprises a cylindrical body, a chamfered part formed by partially cutting one side surface of the cylindrical body in the longitudinal direction such that the cut surface of the cylindrical body is flat, and a pair of disk-shaped heads formed at a top and bottom of the cylindrical body and having a larger diameter than a size of the cylindrical body.

* * * * *